US007558727B2

(12) United States Patent
Gigi

(10) Patent No.: US 7,558,727 B2
(45) Date of Patent: Jul. 7, 2009

(54) METHOD OF SYNTHESIS FOR A STEADY SOUND SIGNAL

(75) Inventor: Ercan Ferit Gigi, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 604 days.

(21) Appl. No.: 10/527,945

(22) PCT Filed: Aug. 5, 2003

(86) PCT No.: PCT/IB03/03381

§ 371 (c)(1),
(2), (4) Date: Mar. 15, 2005

(87) PCT Pub. No.: WO2004/027753

PCT Pub. Date: Apr. 1, 2004

(65) Prior Publication Data

US 2006/0178873 A1 Aug. 10, 2006

(30) Foreign Application Priority Data

Sep. 17, 2002 (EP) ..... 02078848

(51) Int. Cl.
*G10L 13/00* (2006.01)
*G10L 13/08* (2006.01)

(52) U.S. Cl. ..... 704/207; 704/260; 704/268

(58) Field of Classification Search ..... 704/258, 704/260, 261, 266, 267, 268, 205, 207, 208
See application file for complete search history.

(56) References Cited

U.S. PATENT DOCUMENTS 4,344,148 A * 8/1982 Brantingham et al. ..... 708/318
5,357,048 A * 10/1994 Sgroi ..... 84/645
5,479,564 A 12/1995 Votgen et al.
5,983,173 A * 11/1999 Inoue et al. ..... 704/219

(Continued)

FOREIGN PATENT DOCUMENTS

EP 0363233 B1 11/1994

(Continued)

OTHER PUBLICATIONS

Violaro et al., "A Hybrid Model for Text-to-Speech Synthesis", IEEE Transactions on Speech and Audio Processing, vol. 6, Issue 5, Sep. 1998, pp. 426 to 434.*

(Continued)

*Primary Examiner*—Martin Lerner

(57) ABSTRACT

The present invention relates to a method of synthesizing a first sound signal based on a second sound signal, the first sound signal having a required first fundamental frequency and the second sound signal having a second fundamental frequency, the method comprising the steps of, a) determining of required pitch bell locations in the time domain of the first sound signal, the pitch bell locations being distanced by one period of the first fundamental frequency, b) providing of pitch bells by windowing the second sound signal on pitch bell locations in the time domain of the second sound signal, the pitch bell locations being distanced by one period of the second fundamental frequency, c) randomly selecting of a pitch bell from the provided pitch bells for each of the required pitch bell locations, d) performing an overlap and add operation on the selected pitch bells for synthesizing the first signal.

15 Claims, 5 Drawing Sheets

U.S. PATENT DOCUMENTS

Figure 1:
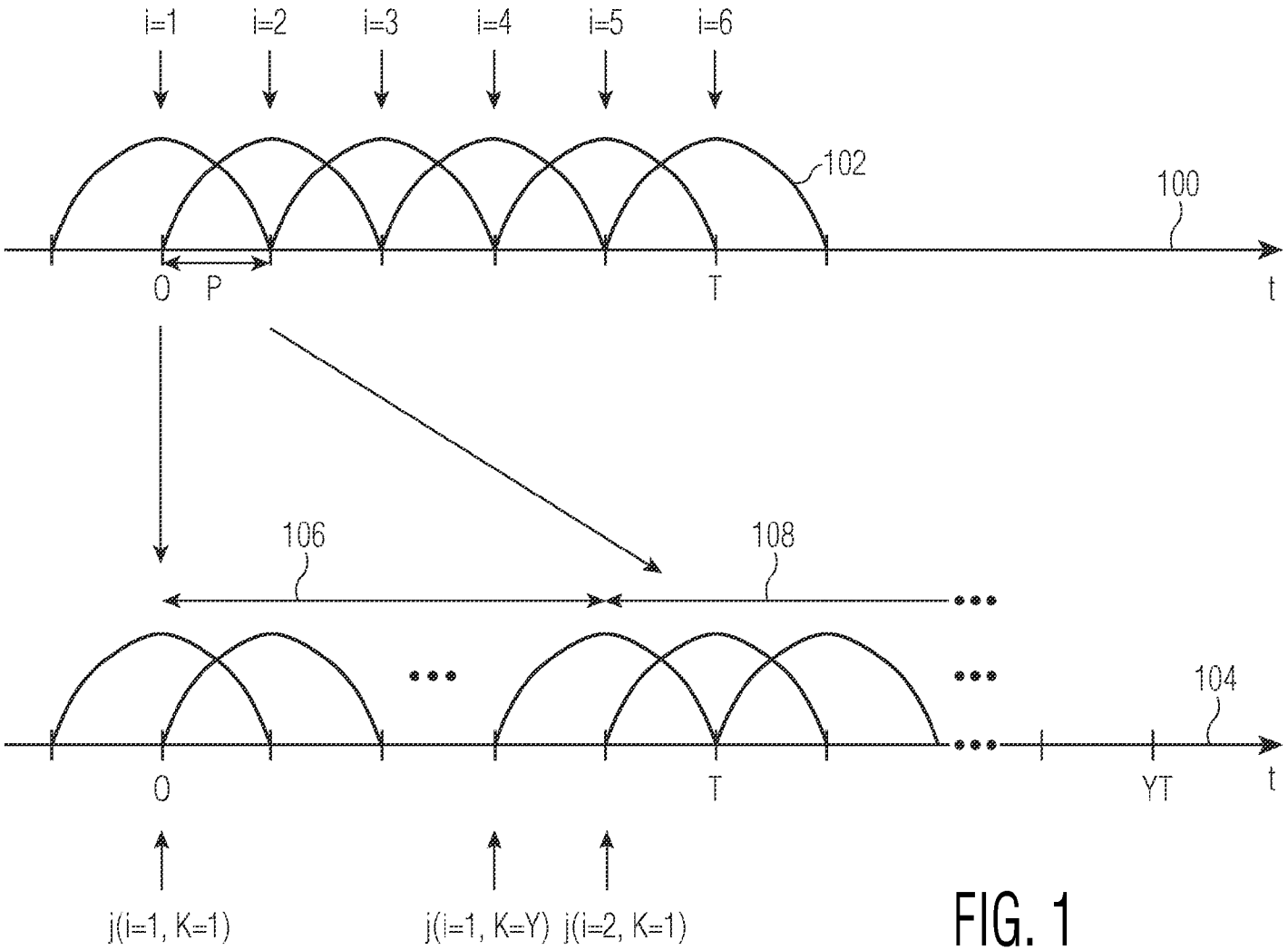
FIG. 1 PRIOR ART

| | | | | |
|---|---|---|---|---|
| 6,026,356 | A | 2/2000 | Yue et al. | |
| 6,047,253 | A * | 4/2000 | Nishiguchi et al. | 704/207 |
| 6,085,157 | A * | 7/2000 | Takeda | 704/208 |
| 6,170,073 | B1 | 1/2001 | Jarvinen et al. | |
| 6,208,960 | B1 * | 3/2001 | Gigi | 704/220 |
| 6,233,550 | B1 | 5/2001 | Gersho et al. | |
| 6,253,171 | B1 | 6/2001 | Yeldener | |
| 6,336,092 | B1 * | 1/2002 | Gibson et al. | 704/268 |
| 6,829,577 | B1 * | 12/2004 | Gleason | 704/207 |
| 7,251,601 | B2 * | 7/2007 | Kagoshima et al. | 704/268 |
| 7,454,330 | B1 * | 11/2008 | Nishiguchi et al. | 704/224 |
| 2003/0182106 | A1 * | 9/2003 | Bitzer et al. | 704/207 |
| 2006/0004578 | A1 * | 1/2006 | Gigi | 704/268 |
| 2006/0053017 | A1 * | 3/2006 | Gigi | 704/267 |
| 2006/0059000 | A1 * | 3/2006 | Gigi | 704/258 |

FOREIGN PATENT DOCUMENTS

| | | |
|---|---|---|
| EP | 0706170 B1 | 8/2001 |

OTHER PUBLICATIONS

Ljolje et al., "Synthesis of Natural Sounding Pitch Contours in Isolated Utterances Using Hidden Markov Models", IEEE Transactions on Acoustics, Speech, and Signal Processing, Oct. 1996, vol. 34, Issue 5, pp. 1074 to 1080.*

Kobayashi et al., "Statistical Properties of Fluctuation of Pitch Intervals and and Its Modeling for Natural Synthetic Speech", Conference on Acoustics, Speech, and Signal Processing, 1990. ICASSP-90, Apr. 3-6, 1990, vol. 1, pp. 321 to 324.*

Fabio Violaro, et al: A Hybrid Model for Text-to-Speech Synthesis, IEEE Transaction on Speech and Audio Processing vol. 6, No. 5, Sep. 1998, pp. 426-434.

Andrej Ljoile, et al: Synthesis of Natural Sounding Pitch Contours in Isolated Utterances Using Hidden Markov Models, IEEE Transactions on Acoustics Speech, and Signal Processing, vol. ASSP 34, No. 5, Oct. 1986, pp. 1074-1080.

Tetsunori Kobayashi, et al: Statistical Properties of Fluctuation of pitch Intervals and Its Modeling for Natural Synthetic Speech, IEEE 1990.

Eric Moulines et al; "Pitch-Synchronous Waveform Processing Techniques for Text-to-Spech Synthesis Using Dipeones", Speech Communicationi vol. 9, 1991, pp. 453-467, North Holland.

* cited by examiner

METHOD OF SYNTHESIS FOR A STEADY SOUND SIGNAL

The present invention relates to the field of synthesizing of speech or music, and more particularly without limitation, to the field of text-to-speech synthesis.

The function of a text-to-speech (TTS) synthesis system is to synthesize speech from a generic text in a given language. Nowadays, TTS systems have been put into practical operation for many applications, such as access to databases through the telephone network or aid to handicapped people. One method to synthesize speech is by concatenating elements of a recorded set of subunits of speech such as demi-syllables or polyphones. The majority of successful commercial systems employ the concatenation of polyphones. The polyphones comprise groups of two (diphones), three (triphones) or more phones and may be determined from nonsense words, by segmenting the desired grouping of phones at stable spectral regions. In a concatenation based synthesis, the conversation of the transition between two adjacent phones is crucial to assure the quality of the synthesized speech. With the choice of polyphones as the basic subunits, the transition between two adjacent phones is preserved in the recorded subunits, and the concatenation is carried out between similar phones.

Before the synthesis, however, the phones must have their duration and pitch modified in order to fulfil the prosodic constraints of the new words containing those phones. This processing is necessary to avoid the production of a monotonous sounding synthesized speech. In a TTS system, a prosodic module performs this function. To allow the duration and pitch modifications in the recorded subunits, many concatenation based TTS systems employ the time-domain pitch-synchronous overlap-add (TD-PSOLA) (E. Moulines and F. Charpentier, "Pitch synchronous waveform processing techniques for text-to-speech synthesis using diphones," Speech Commun., vol. 9, pp. 453-467, 1990) model of synthesis. When the signal to be synthesized is required to have an extended duration this is accomplished by repeating the pitch bells, which have been obtained from the original signal. This repetition process is illustrated in FIG. 1. Time axis 100 belongs to the time domain of the original signal. The original signal has a length of T spanning the time interval between zero and T on the time axis 100. Further, the original signal has a fundamental frequency f, which corresponds to a period p; pitch bells are obtained from the original signal by windowing the original signal by means of windows 102. In the example considered here the windows are spaced apart by the period p in the domain of time axis 100. This way the pitch bell locations i are determined on time axis 100. Time axis 104 belongs to the time domain of the signal to be synthesized. The signal to be synthesized is required to have a duration of yT, where y can be any number. Next a number of pitch bell locations j is determined on the time axis 104. Like on the time axis 100, the pitch bell locations j are spaced apart by the period p corresponding to the fundamental frequency f of the original signal. In order to increase the duration of the original signal each of the original pitch bells obtained from the original signal is repeated a number of y times. This results in a number of intervals 106, 108, . . . in the domain of time axis 104, whereby each of the intervals 106, 108, . . . is composed of repetitions of identical pitch bells. For example the interval 106 contains repetitions of the pitch bell obtained from the pitch bell location i=1 from the original signal at pitch bell locations j (i=1, k=1) to j (i=1, k=y). This means that interval 106 contains a number of y repetitions of the pitch bell obtained from pitch bell location i=1 on time axis 100 of the original signal. Likewise the following interval 108 contains a number of y repetitions of the pitch bell obtained from pitch bell location i=2 from the original signal. As a consequence the synthesized signal is composed of concatenated sequences of pitch bell repetitions.

A common disadvantage of such PSOLA methods is that an extreme duration manipulation introduces audible transitions between the sequences into the signal. In particular this is a problem when the original sound is a hybrid sound like voiced fricatives having both a noisy and a periodic component. The repetition of pitch bells introduces periodicity in the noisy components, which makes the synthesized signal sound unnatural.

The present invention therefore aims to provide an improved method of synthesizing a sound signal, in particular for extreme duration modifications, like for singing.

The present invention provides for a method of synthesizing a sound signal based on an original signal in order to manipulate the duration of the original signal. In particular, the present invention enables extreme duration and pitch modifications of the original signal without audible artefacts. This is especially useful for synthesizing of singing where extreme duration manipulations in the order of 4 to 100 times of the original signal can occur.

In essence, the present invention is based on the observation that prior art PSOLA methods introduce artefacts into a synthesized signal after duration manipulation because the transition from one chain of repeating pitch bells to the next is audible. This effect which is experienced when a prior art PSOLA type method is employed for extreme duration manipulations is particularly detrimental for hybrid sounds containing both a noisy and a periodic component.

In accordance with the invention, pitch bells are randomly selected from the original signal for each of the required pitch bell locations of the signal to be synthesized. This way the introduction of periodicity in the noisy components can be avoided and the naturalness of the original sound is preserved. In accordance with a preferred embodiment of the invention the original sound is a voiced fricative having both a noisy and a periodic component. Application of the present invention to such voiced fricatives is especially beneficial.

In accordance with a further preferred embodiment of the invention a raised cosine is used for windowing of voiced fricatives. For unvoiced sound intervals a sine window is used which has the advantage that the total signal envelope in power domain remains about constant. Unlike a periodic signal, when two noise samples are added, the total sum can be smaller than the absolute value of any of the two samples. This is because the signals are (mostly) not in-phase; the sine window adjusts for this effect and removes the envelope-modulation.

In accordance with a further preferred embodiment of the invention the original sound signal has periods which are spectrally alike and which have basically the same information content. Such periods, which are voiced, are classified by a first classifier and such periods which are unvoiced are classified by means of a second classifier.

In accordance with a further preferred embodiment of the invention the classification information of the original signal is stored in a computer system, such as a text-to-speech system. Intervals of the original signal which are classified as voiced or unvoiced steady periods being spectrally alike are processed in accordance with the present invention whereby a raised cosine window is used for voiced intervals and a sine window is used for unvoiced intervals.

Figure 2:
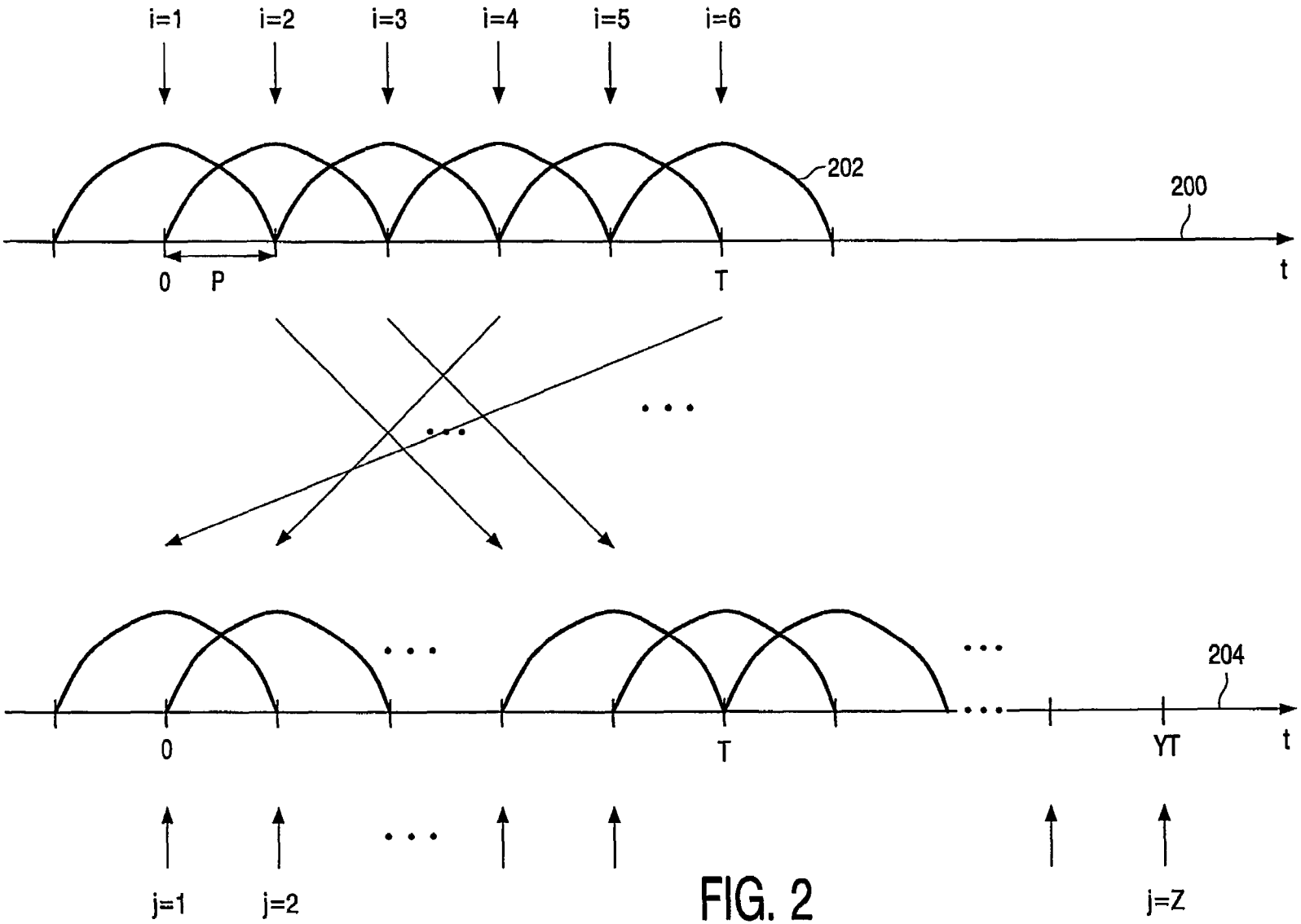
Figure 3:
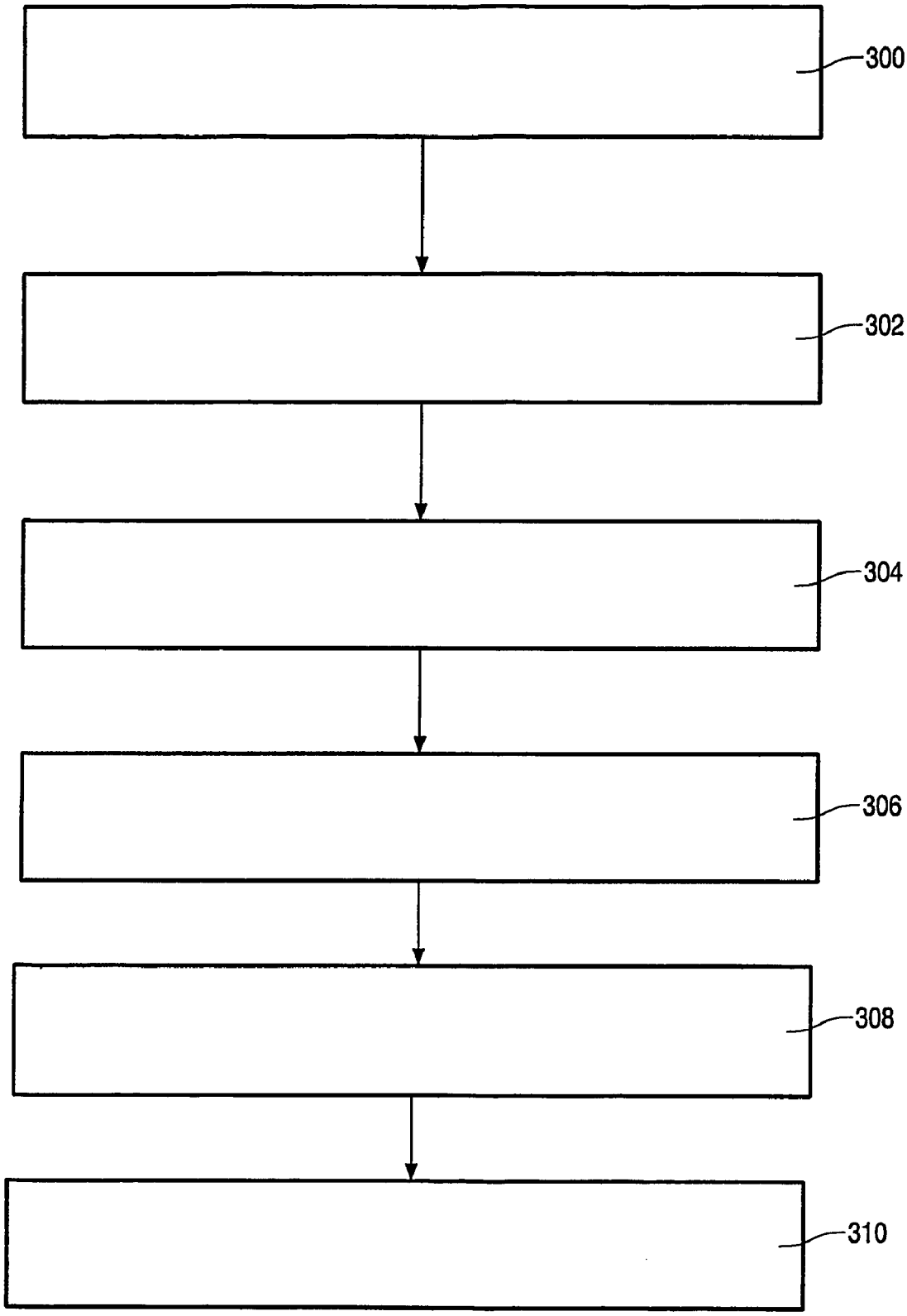
Figure 4:
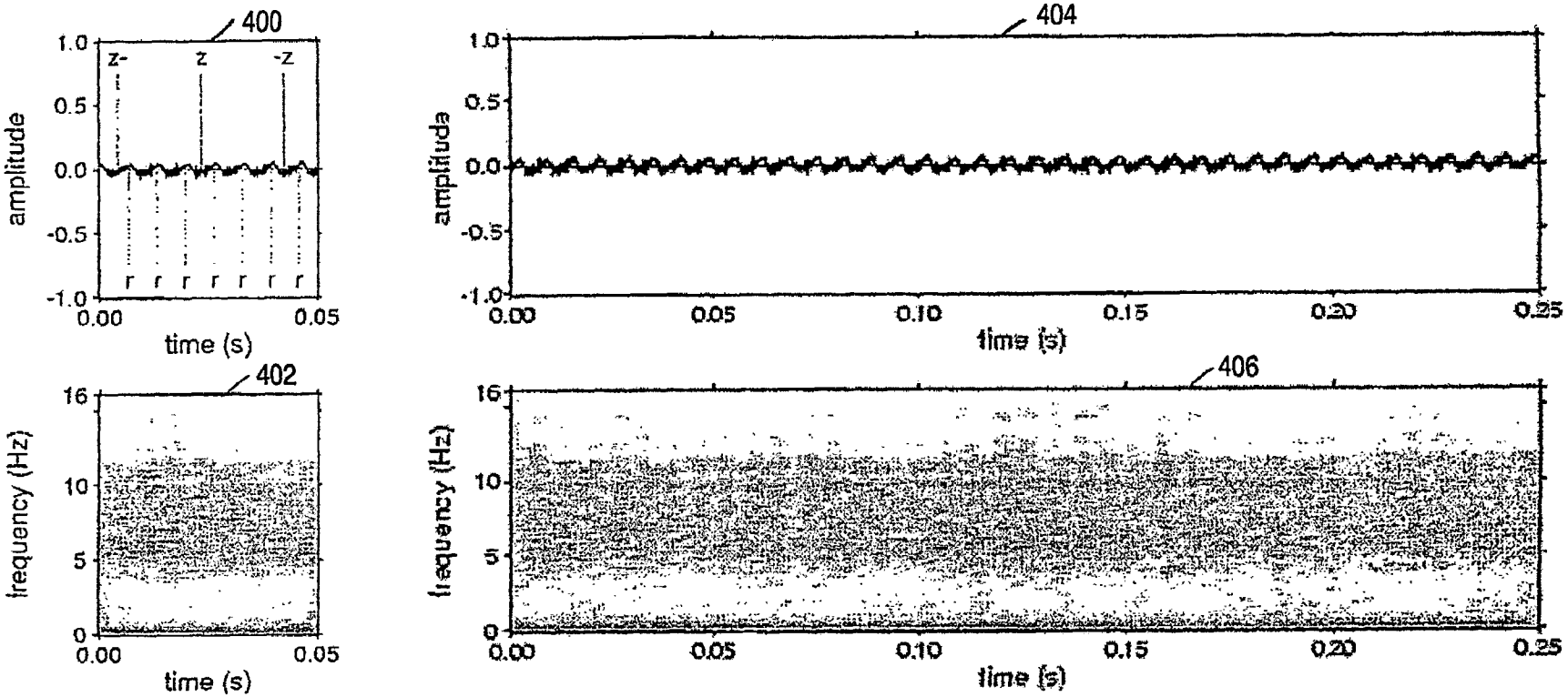
Figure 5:
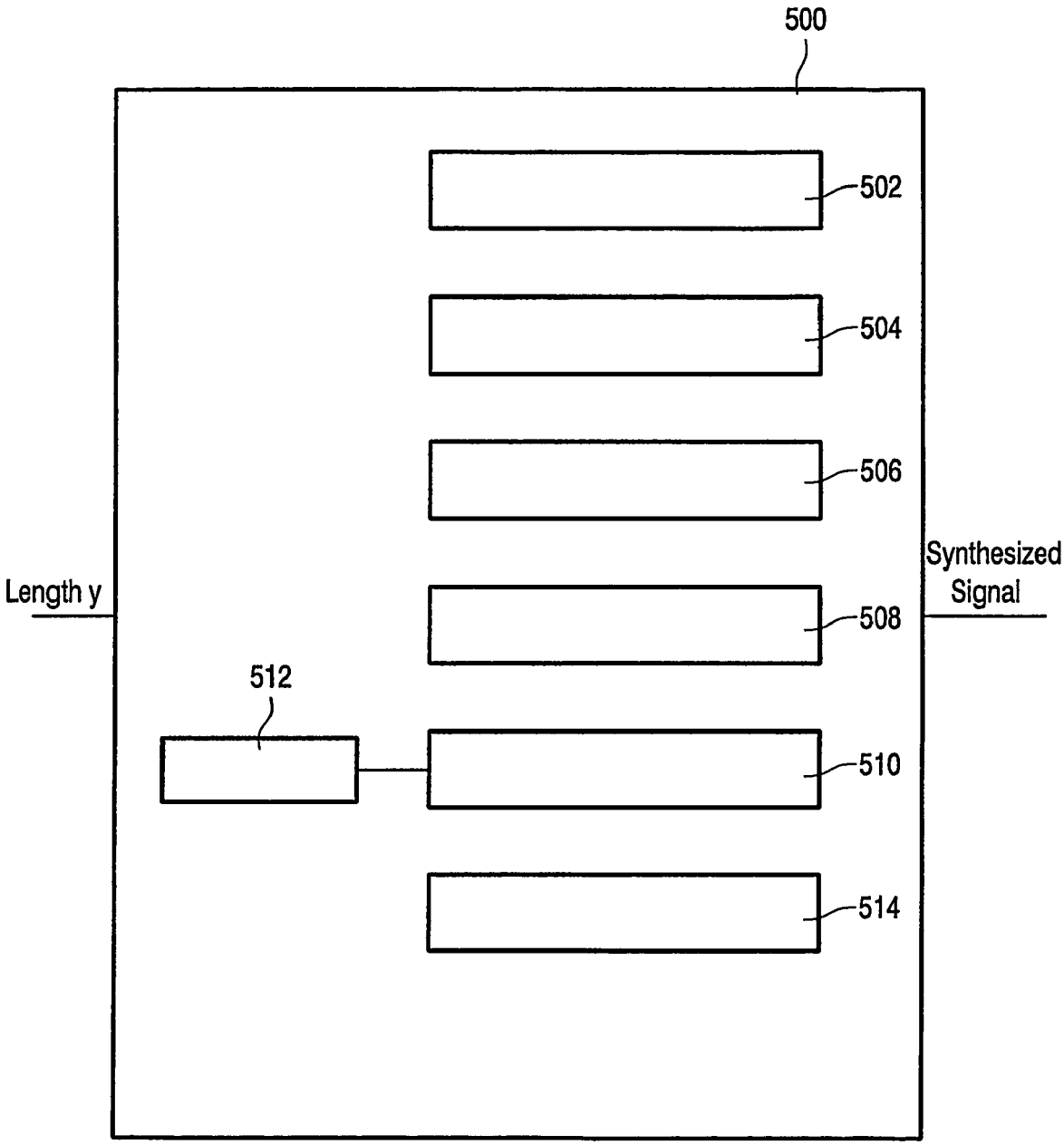

In the following preferred embodiments of the invention are described in greater detail by making reference to the drawings in which:

FIG. 1 is illustrative of a prior art PSOLA-type method,

FIG. 2 is illustrative of an example for synthesizing a sound signal in accordance with an embodiment of the present invention, FIG. 3 is illustrative of a flow chart of an embodiment of a method of the present invention, FIG. 4 shows an example of an original signal and of the synthesized signal, and FIG. 5 is a block diagram of a preferred embodiment of a computer system FIG. 2 shows an example of synthesizing a signal based on an original signal. Time axis 200 is illustrative of the time domain of the original signal. The original signal has a duration T and spans the time between zero and T on time axis 200. The original signal has a fundamental frequency f which corresponds to a period p. The period p determines locations i on time axis 200 for windowing of the original signal by means of window 202. In the example considered here, the original signal is a voiced hybrid sound such that a cosine window in accordance with the following formula is used.

$$w[n] = 0.5 - 0.5 \cdot \cos\left(\frac{2\pi \cdot (n + 0.5)}{m}\right), \quad 0 \le n < m$$

In previous relation, m is the length of the window and n is the running index.

When the original signal is an unvoiced sound signal it is preferred to use the following window.

$$w[n] = \sin\left(\frac{\pi \cdot (n + 0.5)}{m}\right), \quad 0 \le n < m$$

The time domain of the signal to be synthesized is illustrated by time axis 204. The signal to be synthesized is required to have a duration of yT, where y can be any number, for example y=4 or y=6 or y=20 or y=50 or y=100.

The period p does also determine the pitch bell locations j on time axis 204. Like on time axis 200 the pitch bell locations are spaced apart by period p. For each of the required pitch bell locations j, a random selection of a location of a pitch bell i in the time domain of the time axis 200 is made. In the example considered here there is a number of 6 pitch bells which are obtained by windowing of the original signal in the time domain of time axis 200. To select one of these obtained pitch bells for a pitch bell location j a random number between 1 and 6 is generated. This way a random selection from the available pitch bells on pitch bell locations i=1 to i=6 is made. This process is repeated for all required pitch bell locations j on time axis 204. For example a pitch bell for the required pitch bell location j=1 is selected by generating a random number between 1 and 6. In the example considered here, the number 6 is obtained such that the pitch bell obtained from pitch bell location i=6 on the time axis 200 is selected for the required pitch bell location j=1 on the time axis 204. Likewise a random number is generated for the required pitch bell location j=2. The random number is 4 in this example such that the pitch bell at pitch bell location i=4 on time axis 200 is selected for the required pitch bell location j=2. This process is performed for all required pitch bell locations j=1 to j=z on time axis 204. Due to the random selection of the pitch bells from the domain of the original signal, intervals 106, 108, . . . are avoided (cf. FIG. 1). As a consequence no such artefact is introduced into the synthesized signal and the synthesized signal sounds naturally even for extreme duration manipulations.

FIG. 3 shows a flow chart, which is illustrative of this method. In step 300 a recording of an original sound is provided. In step 302 hybrid sound intervals are identified and classified as voiced or unvoiced in the original sound recording. This can be done manually by a human expert or by means of a computer program, which analyses the original signal and/or its frequency spectrum for steady periods. Preferably the first analysis is performed by means of a program and a human expert reviews the output of a program. In step 304 pitch bells are obtained from the original sound signal by means of windowing. Windowing is performed by means of windows which are positioned synchronously with the fundamental frequency of the original sound signal, i.e. the windows are distanced by the period p of the original sound signal in the domain of the original sound signal. In step 306 the pitch bell locations j for which pitch bells are required in order to synthesize the signal are determined. Again the required pitch bell locations j are distanced by the period p. Alternatively the pitch bell locations j can be distanced by another period q corresponding to a higher or lower required fundamental frequency of the signal to be synthesized. This way the duration and the frequency can be modified. In step 308 a random selection of pitch bells is made for each of the required pitch bell locations j within the sound interval which is classified as hybrid. For other sound intervals a prior art PSOLA-type method may or may not be employed. In step 310 the pitch bells are overlapped and added on the pitch bell locations j in the domain of the signal to be synthesized.

FIG. 4 shows an example of an original sound signal 400 which is a diphone of /z/ to /z/ transition. Also the frequency spectrum 402 of the sound signal 400 is shown in FIG. 4. FIG. 4.

Sound signal 404 is obtained from sound signal 400 in accordance with the present invention by randomly selecting pitch bells obtained from the sound signal 400 for the required pitch bell locations in the time domain of the synthesized sound signal 404. In the example considered here the synthesized sound signal 404 is y=5 times longer than the original sound signal 400. Also the frequency spectrum 406 of the sound signal 404 is shown in FIG. 4. As apparent from the sound signal 404 and its frequency spectrum 406 the characteristics of the original sound signal 400 are preserved in the synthesized signal and no artefacts are introduced. As a consequence the sound signal 404 sounds identical to the sound signal 400 but is 5 times longer.

FIG. 5 shows a block diagram of a computer system, such as a text-to-speech synthesis system. The computer system 500 comprises a module 502 for storing of an original sound signal. Module 504 serves to enter and store sound classification information for the original sound signal stored in module 502. For example, steady voiced periods are marked with an 'r' and steady unvoiced periods are marked with an 's' in the original sound signal. Module 506 serves for windowing of the original sound signal of module 502 in order to obtain pitch bells. Depending on the sound classification a raised cosine or a sine window is used for steady voiced periods or steady unvoiced periods, respectively. Module 508 serves to determine the required pitch bell locations j in the time domain of the signal to be synthesized. In order to determine the required pitch bell locations j the input parameter 'length y' is utilized. The input parameter length y specifies the multiplication factor for the duration of the original signal. Further it is possible to provide a dynamically varying pitch as an additional input parameter to modify the fundamental frequency in addition to or instead of the duration.

Module 510 serves to select pitch bells from the set of pitch bells obtained from the original sound signal. Module 510 is coupled to pseudo random number generator 512. For each of the required pitch bell locations in the domain of the signal to be synthesized, a pseudo random number is generated by pseudo random number generator 512. By means of these random numbers selections of pitch bells from the set of pitch bells are made by module 510 in order to provide a randomly selected pitch bell for each of the required pitch bell locations in the time domain of the signal to be synthesized. Module 514 serves to perform an overlap and add operation on the selected pitch bells in the time domain of the signal to be synthesized. This way the synthesized signal having the required duration is obtained.

It is to be noted that the present invention can be applied on steady regions. For example, such a steady region can be a vowel or a noisy voiced sound like /z/. Hence, the invention is not restricted to 'hybrid' sounds.

Furthermore, it is to be noted that the synthesized signal does not need to have the same pitch (fundamental frequency) as the original. In some applications it is required to change the pitch, for example in order to synthesize singing. In order to accomplish this change of fundamental frequency in the synthesized signal, the period locations in the synthesized signal will be placed more closely or more away from each other than the original. This does not otherwise change the synthesis procedure.

Further it is to be noted that the present invention is not restricted to a certain choice of a window. Instead of raised cosine or sine windows other windows can be used such as triangular windows.

The invention claimed is:

1. A method of synthesizing a first sound signal based on a second sound signal, the first sound signal having a required first fundamental frequency and the second sound signal having a second fundamental frequency, the method comprising the steps of:

determining required pitch bell locations in the time domain of the first sound signal, the pitch bell locations being distanced by one period of the first fundamental frequency, providing a plurality of pitch bells by windowing the second sound signal based on pitch bell locations in the time domain of the second sound signal, the pitch bell locations of the second sound signal being distanced by one period of the second fundamental frequency, said windowing being determined based on a type of said second sound signal;

randomly selecting one of said pitch bells from the provided pitch bells for each of the required pitch bell locations, said selection being uniformly distributed among said number of provided pitch bells; and performing an overlap and add operation on the selected pitch bells for synthesizing the first signal.

2. The method of claim 1, wherein the second sound signal is a hybrid sound comprising a noisy and periodic component.

3. The method of claims 1 wherein the second sound signal comprises a voiced fricative sound signal.

4. The method of claim 1, wherein the second sound signal comprises voiced sound signal and wherein a raised cosine is used for windowing of the second sound signal.

5. The method of claim 1, wherein the second sound signal comprises an unvoiced sound signal and wherein a sine window is used for windowing of the second sound signal.

6. The method of claim 1, wherein the second sound signal has spectrally alike periods, the spectrally alike periods having basically the same information content.

7. The method of claim 1, wherein the required first fundamental frequency and the second fundamental frequency are substantially the same.

8. A computer system, in particular text-to-speech synthesis system, for synthesizing a first sound signal based on a second sound signal, the first sound signal having a required first fundamental frequency and the second sound signal having a second fundamental frequency, the computer system comprising:

means for determining required pitch bell locations in the time domain of the first sound signal, the pitch bell locations being distanced by one period of the first fundamental frequency, means for providing a plurality of pitch bells by windowing the second sound signal based on pitch bell locations in the time domain of the second sound signal, the pitch bell locations of the second sound signal being distanced by one period of the second fundamental frequency, said windowing being determined based on a type of said second signal, means for randomly selecting one of a said pitch bells from the provided pitch bells for each of the required pitch bell locations, said selection being uniformly distributed among said number of provided pitch bells; and means for performing an overlap and add operation on the selected pitch bells for synthesizing the first signal.

9. The computer system of claim 8 further comprising:

means for storing of sound classification data, the means for storing of sound classification data being adapted to store data being indicative of an interval containing the second sound signal within an original sound signal.

10. A method for construction a synthesizing signal comprising:

determining a plurality of pitch bell locations within an original sound signal, said locations being distanced by one period of a fundamental frequency;

determining a plurality of pitch bells associated with each of said pitch bell locations, said pitch bells being determined by windowing said original sound signal, said windowing being determined based on a type of said original signal;

determining a plurality of pitch bell locations within a signal to be synthesized, said locations being distanced by one period of a frequency associated with said synthesized signal;

randomly selecting for each of a plurality of pitch bell locations within said synthesized signal one of said pitch bells associated with said original signal; and overlapping and adding said selected of pitch bells at said synthesized signal pitch bell locations.

11. A device for synthesizing a first sound signal based on a second sound signal, the device comprising:

a first module configured to determine required pitch bell locations of the first sound signal;

a windowing module configured to provide a plurality of pitch bells by windowing the second sound signal based on pitch bell locations of the second sound signal, said windowing being determined based on a type of said second signal, a selector configured to randomly select one of said pitch bells from the provided pitch bells for each of the required pitch bell locations, said selection being uniformly distributed among said number of provided pitch bells; and an adder configured to overlap and add the selected pitch bells for synthesizing the first signal.

12. The device of claim 11, wherein the pitch bell locations of the first sound signal are distanced by one period of a first fundamental frequency of the first sound signal, and the pitch bell locations of the second sound signal are distanced by one period of a second fundamental frequency of the second sound signal.

13. The device of claim 11, wherein the required pitch bell locations are in a time domain of the first sound signal.

14. The device of claim 11, wherein the windowing is based on the pitch bell locations in a time domain of the second sound signal.

15. The device of claim 11, further comprising a module configured for storing of sound classification data indicative of an interval containing the second sound signal within an original sound signal.

* * * * *